US008167655B2

(12) United States Patent
Wang

(10) Patent No.: US 8,167,655 B2
(45) Date of Patent: May 1, 2012

(54) PORTABLE MULTI-FUNCTIONAL DATA STORAGE TRANSMITTING AND CONNECTING DEVICE

(76) Inventor: Hong Wang, Dongguan (CN)

( * ) Notice: Subject to any disclaimer, the term of this patent is extended or adjusted under 35 U.S.C. 154(b) by 0 days.

(21) Appl. No.: 12/736,845

(22) PCT Filed: Mar. 31, 2009

(86) PCT No.: PCT/CN2009/000347

§ 371 (c)(1),
(2), (4) Date: Nov. 12, 2010

(87) PCT Pub. No.: WO2009/137984

PCT Pub. Date: Nov. 19, 2009

(65) Prior Publication Data

US 2011/0065321 A1 Mar. 17, 2011

(30) Foreign Application Priority Data

May 12, 2008 (CN) ..... 2008 1 0028038

(51) Int. Cl.
*H01R 13/66* (2006.01)

(52) U.S. Cl. ..... 439/620.01

(58) Field of Classification Search ..... 439/620.01, 439/620.15, 620.22, 76.1, 660
See application file for complete search history.

(56) References Cited

U.S. PATENT DOCUMENTS 6,918,790 B2 * 7/2005 Wan et al. ..... 439/620.21
* cited by examiner

*Primary Examiner* — Javaid Nasri

(57) ABSTRACT

A multi-functional data storage and transmitting and connecting device for an electronic device, includes a data transfer cable having a predetermined length, at least a first and a second connector provided at two ends of the data transfer cable respectively and a coupling element. The coupling element includes a plurality of connector sockets adapted for fittedly and detachably receiving the connectors so as to detachably couple the connectors into a handy structure, a control circuitry received in the coupling element, and a hanging device. The control circuitry includes an integrated circuit chipset, a rechargeable battery provided within the coupling element for recharging the electronic device, a call receiving circuitry electrically connected with the integrated circuit chipset, a speakerphone electrically connected with said call receiving circuitry, an amplifier adapted for amplifying audio signal, and a wireless transceiver electrically connected with the integrated circuit chipset for wirelessly receiving and transmitting signal.

7 Claims, 3 Drawing Sheets

PORTABLE MULTI-FUNCTIONAL DATA STORAGE TRANSMITTING AND CONNECTING DEVICE

BACKGROUND OF THE PRESENT INVENTION

1. Field of Invention

The present invention relates to an electronic device, and more particularly to a multi-functional data storage transmitting and connecting device.

2. Description of Related Arts

Conventional electronic devices, such as cellular phones, digital cameras, MP3/MP4 music players, digital camcorders need electrical connection with a computer for data transfer. Traditionally, such data transfer is accomplished by a USB transfer device having a data transfer cable and two connectors provided at two ends of the data transfer cable. Very often, the data transfer cable has an extended length so as to facilitate data transfer even if the electronic devices are at a distance from the computer. A disadvantage of having an extended length for the data transfer cable is that such a long cable is inconvenient for a user to carry or store. Furthermore, since the data transfer cable is very long in length, it will tangle very easily to become a confused mass of cable. This tangling of the data transfer cable may cause damage to the cable itself. In addition, the two connectors are usually unprotected and exposed to ambient environment. As a result, the connectors are easily damaged by other objects.

On the other hand, the above mentioned electronic devices need recharging very frequently. A conventional method for recharging is to recharge the relevant electronic device with a predetermined charger. The charger is connected to an external power source, while the electronic device is electrically connected to the charger through a power transfer cable, which is detachably connected to the electronic device and the charger. Since both the charger and the power transfer cable are need for a successful recharge process, this presents great inconvenience to users of conventional electronic devices because they have to carry the chargers and the corresponding power transfer cables with them. There exist some emergency charging stations which are designed to provide temporary charging to electronic devices when users of the electronic devices forgot to bring the official chargers with them. However, users still need to get a separate power transfer cable for charging their electronic devices.

SUMMARY OF THE PRESENT INVENTION

The invention is advantageous in that it provides a multi-functional data storage transmitting and connecting device which is capable of facilitating convenient date transfer between an electronic device and a host computer, providing temporary or emergency charging to a wide range of electronic devices, amplifying audible signal originated from electronic devices, and wirelessly transmitting and receiving signal to and from the electronic device. Furthermore, the multi-functional data storage transmitting and connecting device is adapted for use as a personal accessory so as to allow convenient storage and carrying. These functions and advantages of the present invention substantially resolve the above-mentioned problems for conventional electronic devices and their data transfer and charging devices.

According to the present invention, the foregoing and other objects and advantages are attained by providing a multi-functional data storage and transmitting and connecting device for an electronic device, comprising a data transfer cable having a predetermined length, at least a first and a second connector provided at two ends of said data transfer cable respectively and a coupling element. The coupling element comprises a plurality of connector sockets adapted for fittedly and detachably receiving said connectors so as to detachably couple said connectors into a handy structure, and a control circuitry received in said coupling element. The control circuitry comprises an integrated circuit chipset, a rechargeable battery provided within said coupling element for providing a predetermined amount of power to recharge said electronic device when at least one of said connectors is connected thereto, a call receiving circuitry electrically connected with said integrated circuit chipset, a speakerphone electrically connected with sad call receiving circuitry, an amplifier adapted for amplifying audio signal, and a wireless transceiver electrically connected with the integrated circuit chipset for wireless receiving and transmitting signal, and a hanging device extended from said coupling element for hanging onto an external object.

The present invention has the following distinctive features over prior art.

The multi-functional data storage and transmitting and connecting device further comprises a security device comprising a security transceiver and a warning speaker provided on the security device.

The rechargeable battery of the coupling element is electrically connected with the first connector socket for temporarily charging the electronic device when the electronic device is electrically connected with the first connector socket via the data transfer cable.

The first connector has a protrusion and the second connector has an engagement slot formed thereon wherein the protrusion is arranged to detachably engage with the engagement slot when the data transfer cable is bent into a U-shaped cross section.

The second connector can be embodied as a USB connector, or other digital connectors not necessarily for USB ports.

The coupling element comprises a resilient actuator provided thereon in such a manner that the resilient actuator normally locks up the coupling element on the first and the second connector, but when the resilient actuator is actuated, the resilient actuator is arranged to release the holding force and allow the coupling element to detach from the first and the second connector.

The above-mentioned multi-functional data storage and transmitting and connecting device addresses the problems for conventional data transfer devices, such as conventional transfer cables their limited usage problem. The present invention facilitates data transfer, wireless transceiver function, hand-free speaking between a caller and the user, incoming call alerts, emergency charging, security warning, and connector protection. These resolve the conventional problems such as inconvenient to carry and store on the part of the user. The present invention can be reduced into a compact size for the use of trendy personal accessory hung on existing cellular phones, MP3/MP4 players or key chains. Widespread application of the present invention is expected.

Still further objects and advantages will become apparent from a consideration of the ensuing description and drawings. These and other objectives, features, and advantages of the present invention will become apparent from the following detailed description, the accompanying drawings, and the appended claims.

Figure 1:
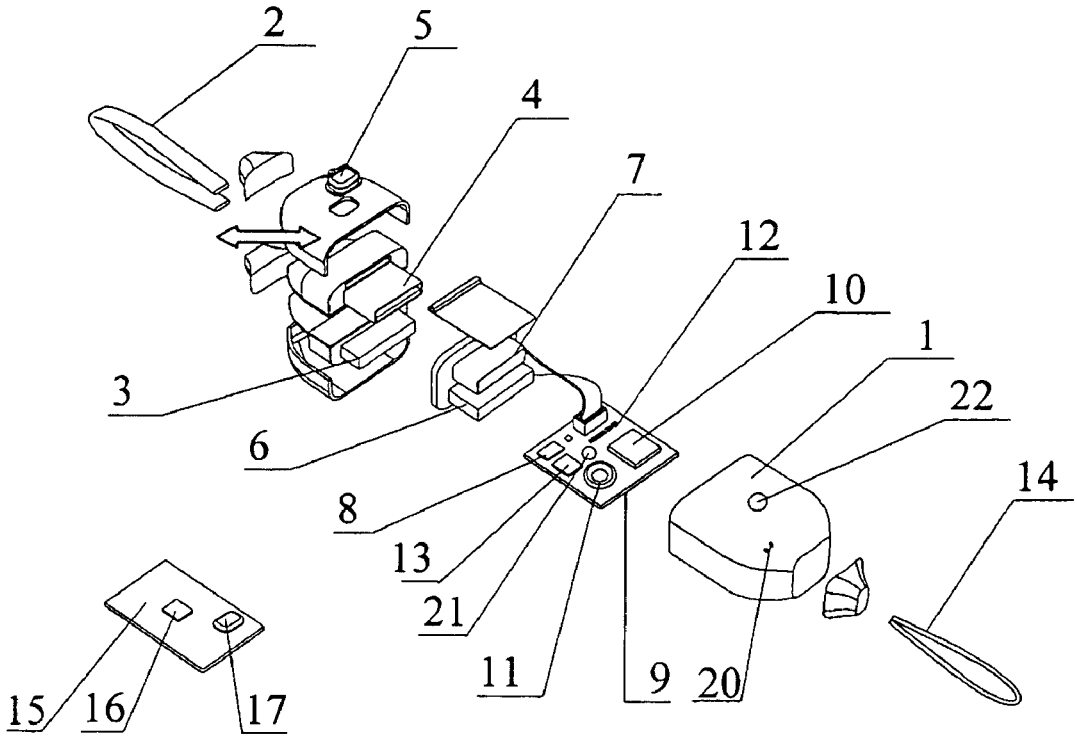
FIG. 1 is a perspective view of a multi-functional data storage transmitting and connecting device according to a preferred embodiment of the present invention.

In the above drawings, 1. Coupling element, 2. Data transfer cable, 3. First connector, 4. Second connector, 5. Resilient actuator, 6. First connector socket, 7. Second connector socket, 8. Control circuitry, 9. Integrated circuit chipset, 10. Rechargeable battery, 11. Speakerphone, 12. Amplifier, 13. Wireless transceiver, 14. Hanging device, 15. Security device, 16. Security transceiver, 17. Warning speaker, 18. Protrusion, 19. Engagement slot, 20. Microphone, 21. Illuminator, 22. Illuminating slot.

DETAILED DESCRIPTION OF THE PREFERRED EMBODIMENT

Referring to FIG. 1 to FIG. 4 of the drawings, a multi-functional data storage transmitting and connecting device according to a preferred embodiment of the present invention is illustrated, in which the multi-functional data storage transmitting and connecting device comprises a data transfer cable 2 having a predetermined length which is short enough to prevent unwanted tangling and inconvenience to users of the present invention, a first and a second connector (connector A and connector B) 3, 4 provided at two ends of the date transfer cable 2 respectively, and a coupling element 1 detachably attached to the data transfer cable 2 so as to selectively couple the first and the second connector 3, 4 to form a single handy structure. The coupling element 1 comprises a first and a second connector socket (connector socket A and connector socket B) 6, 7 adapted for fittedly and detachably receiving the first and the second connector 3, 4 respectively so as to detachably couple the first and the second connector 3, 4 into a single handy structure. The coupling element 1 further comprises a control circuitry 8 comprising an integrated circuit chipset 9, a rechargeable battery 10 such as a lithium-ion battery for providing a predetermined amount of power to recharge the electronic device when at least one of the connectors 3, 4 is connected thereto for recharging, a call receiving circuitry, an illuminator 21, a speakerphone 11, an amplifier 12, a wireless transceiver 13, and a hanging device 14 extended from the coupling element 1.

According to the preferred embodiment of the present invention, as shown in FIG. 1*b* of the drawings, the a multi-functional data storage transmitting and connecting device further comprises a security device 15 comprising a security transceiver 16 and a warning speaker 17 provided on the security device 15.

The rechargeable battery 10 of the coupling element 1 is electrically connected with the first connector socket 6. On the other hand, the first connector 3 further has a protrusion 18 and the second connector further has an engagement slot 19 formed thereon wherein the protrusion 18 is arranged to detachably engage with the engagement slot 19 when the data transfer cable 3 is bent into a U-shaped cross section. In this case, both the first and the second connector 3, 4 are then held by the coupling element 1 so as to selectively couple the first and the second connector 3, 4 into a single structural piece. The coupling element 1 further comprises a resilient actuator 5 provided thereon in such a manner that the resilient actuator 5 normally locks up the coupling element 1 on the first and the second connector 3, 4, but when the resilient actuator 5 is actuated, the resilient actuator 5 is arranged to release the holding force and allow the coupling element 1 to detach from the first and the second connector 3, 4. Moreover, the hanging device 14 is preferably embodied as a hanging string for hanging the multi-functional data storage and transmitting and connecting device on an external object.

The coupling element 1 further comprises the control circuitry 8 comprising an integrated circuit chipset 9, a rechargeable battery 10 such as a lithium-ion battery for providing a predetermined amount of power to recharge the electronic device when at least one of the connectors 3, 4 is connected thereto for recharging. The control circuitry 8 also comprises a call receiving circuitry and an illuminator 21, wherein the rechargeable battery 10 is electrically connected to the first connector socket 6, so that the rechargeable battery 10 is arranged to temporarily recharge the electronic device in an emergency basis when data transfer cable 2 is electrically connecting the first connector socket 6 with the electronic device through the first connector 3. It is worth mentioning that when the rechargeable battery 10 is out of battery because of its recharging activity, it can be replaced or recharged so as to prepare for next recharging process for the electronic device.

Since the control circuitry 8 comprises the call receiving circuitry, the illuminator 21, the speakerphone 11, the amplifier 12, and the wireless transceiver 13, the multi-functional data storage and transmitting and connecting device can be used in conjunction with a cellular phone. More specifically, the wireless transceiver 13 is arranged to wirelessly pair with the electronic device which is embodied as a cellular phone, such that when an incoming call is received by the cellular phone, the cellular phone is arranged to send a wireless signal to the wireless transceiver 13 so as to activate the illuminator 21 to generate an illumination as a signal of the presence of an incoming call. The illumination can be observed through an illuminating slot 22 provided on the coupling element 1. When a user observes the illumination generated by the illuminator 21, the user may activate the speakerphone 11 to answer the incoming call in a hand-free manner. The amplifier 12 is arranged to perform the necessary amplifying function for the audible signal generated by both the caller and the user of the present invention.

The multi-functional data storage and transmitting and connecting device of the present invention may also be used in conjunction with a speaker system of a vehicle. In this mode of operation, the wireless transceiver 13 is electrically connected with the electronic device through the second connector 4. In this mode of operation, the electronic device is preferably embodied as a music player or a radio so that the electronic device is arranged to transmit audio signal to the wireless transceiver 13 through the second connector 4. The wireless transceiver 13 is then arranged to transmit the audio signal to the speaker system of the vehicle so that the built-in speaker system of the vehicle can deliver audible sound (such as music) originated from the electronic device. In other words, the user is able to play his or her music stored in the electronic device through the vehicle's speaker system.

In a similar fashion, when the electronic device is embodied as a cellular phone again, the conversation originated from the caller may then be wirelessly transmitted to the vehicle's speaker system through the wireless transceiver 13 and the second connector 4 so as to accomplish hand-free conversation between the caller and the user of the present invention through a microphone 20.

As mentioned above, the multi-functional data storage transmitting and connecting device comprises the security device 15 which comprises the security transceiver 16 and the warning speaker 17. According to the preferred embodiment of the present invention, the security transceiver 16 is wirelessly communicated with the wireless transceiver 13 of the coupling element 1 in such a manner that when the security device 15 and the coupling element 1 are normally kept within a predetermined distance, the warning speaker 17 is deactivated to stay in an idle mode, wherein when the security device 15 and the coupling element 1 is separated from a distance which is larger than the predetermined distance, the security transceiver 16 is arranged to activate the warning speaker 17 to generate a warning audible sound. As a result, the user can put the security device 15 into his or her wallet and carry the coupling element 1 with him or her on his or her body. In normal circumstances, the distance between the security device 15 and the coupling element 1 is kept at a normal range, which is smaller than the predetermined distance mentioned above. When the wallet is stolen, the distance between the coupling element 1 and the security device 15 will be greatly increased. The wireless transceiver 13 will then wirelessly send a signal to the security transceiver 16 which then activates the warning speaker 17 to generate an audible sound. This audible sound serves as a warning to other people.

Figure 2:
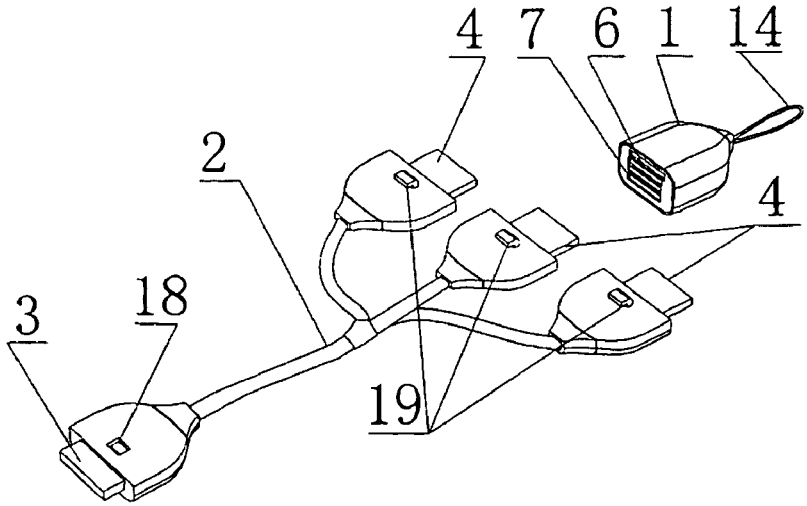
FIG. 2 is a schematic diagram of the multi-functional data storage transmitting and connecting device according to the above preferred embodiment of the present invention.
Figure 3:
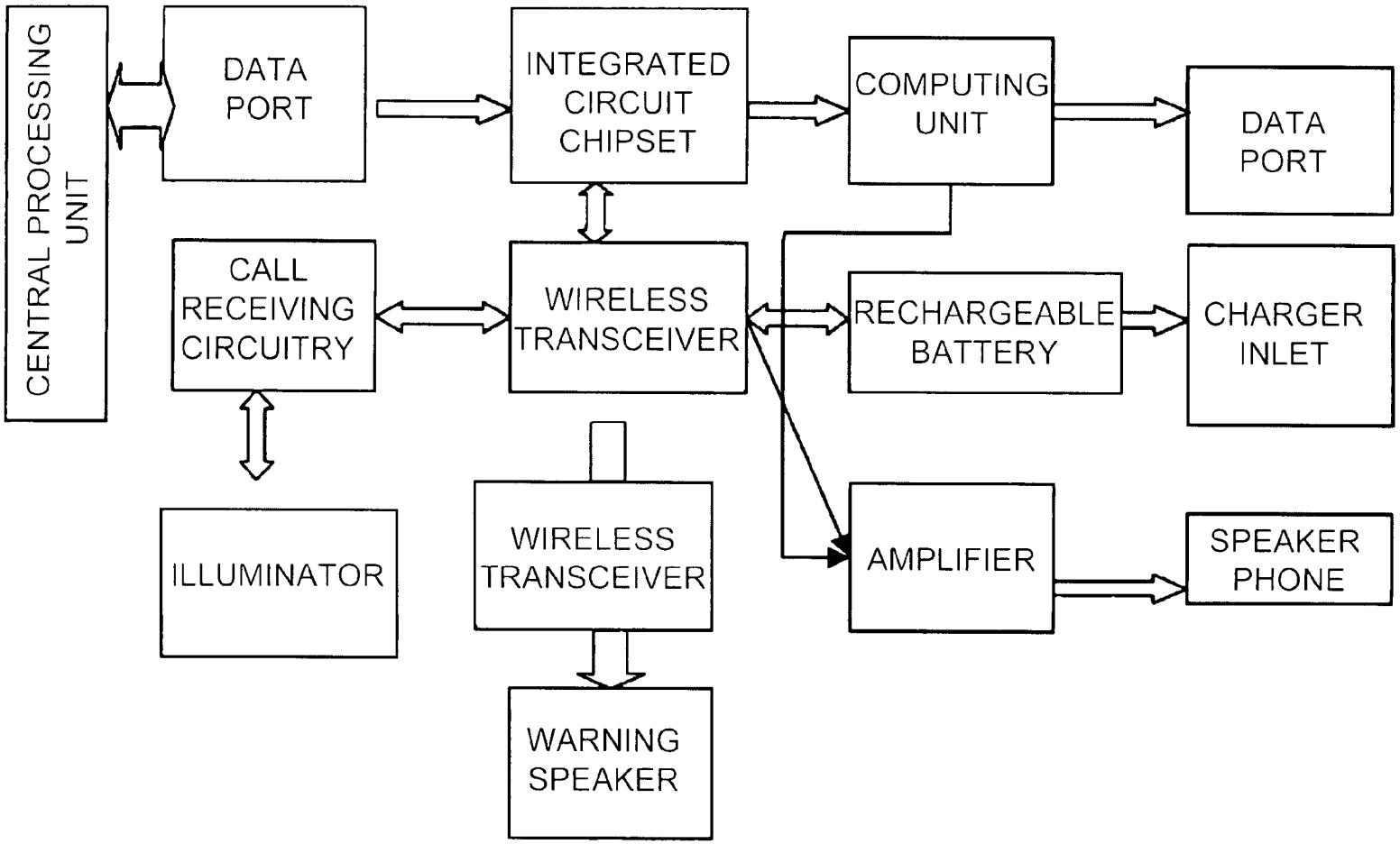
FIG. 3 is a block diagram of the multi-functional data storage transmitting and connecting device according to the above preferred embodiment of the present invention.
Figure 4:
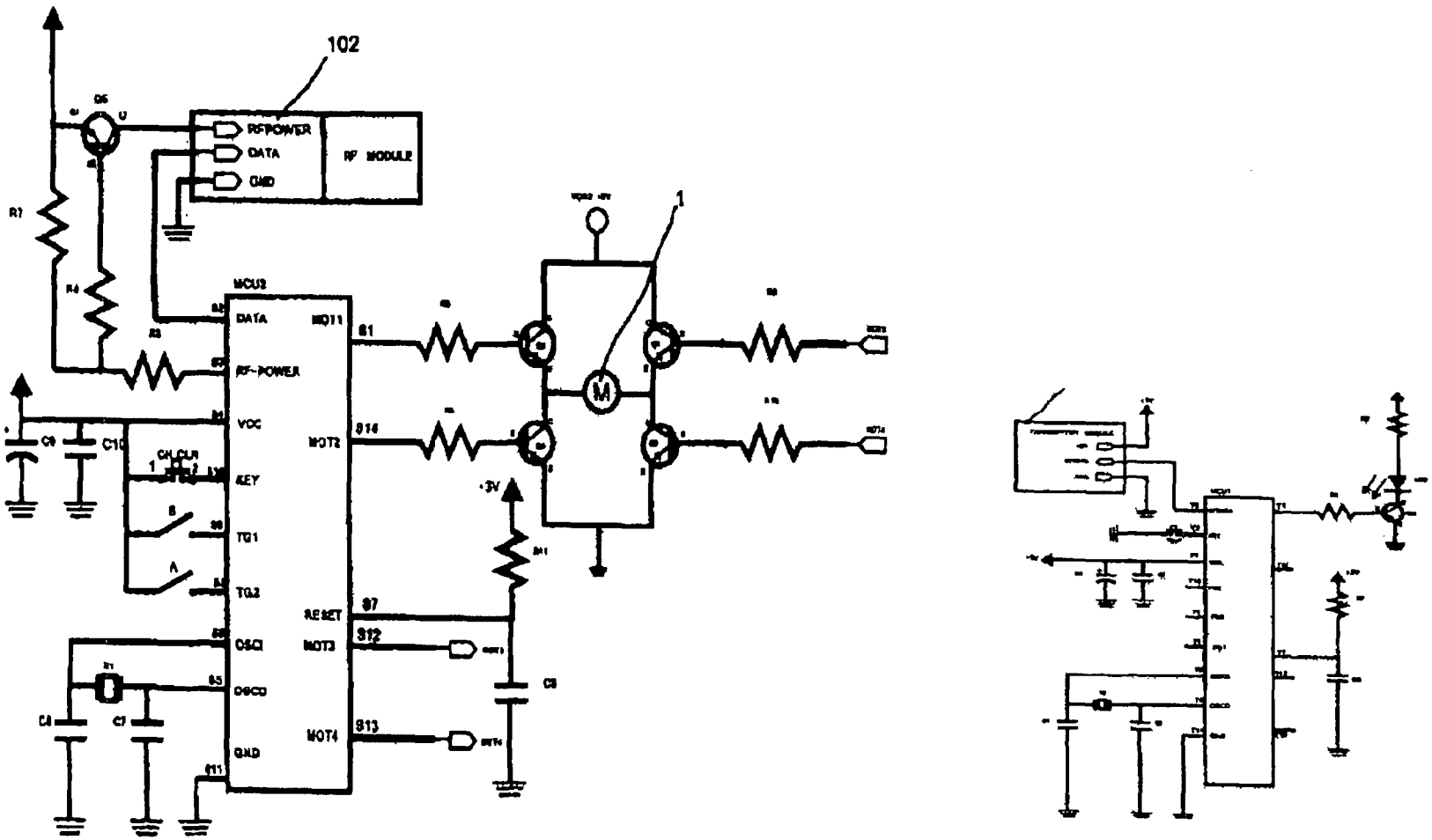
FIG. 4 is a circuit diagram of the multi-functional data storage transmitting and connecting device according to the above preferred embodiment of the present invention.

As mentioned earlier, each of the first and the second connector 3, 4 has the protrusion 18 and the engagement slot 19 formed thereon for detachably engaging with the coupling element 1 so as to selectively allow the coupling element 1 to selectively couple the first and the second connector 3, 4 into the single structural piece. It is worth mentioning that the second connector may be embodied as a single USB connector. Alternatively, as shown in FIG. 2 of the drawings, the coupling element may comprise a plurality of second connectors 4 each embodied as a USB connector for electrically connecting with different electronic devices simultaneously, such as a cellular phone, a digital camera, a MP3/MP4 player, a digital camcorder etc. When the second connector 4 is embodied as a single USB connector, the first and the second connector 3, 4 are arranged to plug into the first and the second connector sockets 6, 7 respectively while the protrusion 18 and the engagement slot 19 are arranged to engage with the coupling element 1 so as to allow the first and the second connector 3, 4 to be securely coupled into a single piece and fully protected by the coupling element 1. When there is a plurality of second connectors 4, the coupling element 1 further has a plurality of receiving slots formed therein, wherein the second connectors 4 are stacked and fittedly received into the receiving slots respectively. It is worth mentioning that the second connector 4 can also be embodied as other digital connectors and not necessarily for USB port(s). The first connector 3 is connected to the computer while the second connector 4 is connected to the electronic device for facilitating data transfer between the computer and the electronic device. Furthermore, the coupling element 1 can also be embodied as a cap for protecting the first and the second connector 3, 4.

It is important to mention that the multi-functional data storage and transmitting and connecting device can be used in a wide variety of circumstances. Even if the data transfer cable 3 is lost, the user may get another data transfer cable 3 and use the coupling element 1 for answering incoming calls and for charging the electronic device. Moreover, the coupling element 1 can also be used for indicating incoming calls and wireless transferring multimedia data to be played in vehicle's speaker system. It can also be used for security purpose.

One skilled in the art will understand that the embodiment of the present invention as shown in the drawings and described above is exemplary only and not intended to be limiting. It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A multi-functional data storage and transmitting and connecting device for an electronic device, comprising a data transfer cable having a predetermined length, at least a first and a second connector provided at two ends of said data transfer cable respectively, and a coupling element, wherein said coupling element comprises a first and a second connector socket adapted for fittedly and detachably receiving said first and said second connector respectively so as to detachably couple said first and said second connector into a handy structure, a control circuitry received in said coupling element, and a hanging device, wherein said control circuitry comprises an integrated circuit chipset, a rechargeable battery provided within said coupling element for providing a predetermined amount of power to recharge said electronic device when at least one of said connectors is connected thereto, a call receiving circuitry electrically connected with said integrated circuit chipset, a speakerphone electrically connected with said call receiving circuitry, an amplifier adapted for amplifying audio signal, and a wireless transceiver electrically connected with the integrated circuit chipset for wireless receiving and transmitting signal, wherein said hanging device is extended from said coupling element for hanging onto an external object.

2. The A multi-functional data storage and transmitting and connecting device, as recited in claim 1, further comprising a security device comprising a security transceiver and a warning speaker provided on the security device, wherein said security transceiver is wirelessly communicated with the wireless transceiver of said coupling element in such a manner that when said security device and said coupling element are normally kept within a predetermined distance, said warning speaker is deactivated to stay in an idle mode, wherein when said security device and said coupling element is separated from a distance which is larger than said predetermined distance, said security transceiver is arranged to activate said warning speaker to generate a warning audible sound.

3. The multi-functional data storage and transmitting and connecting device, as recited in claim 2, wherein said rechargeable battery of said coupling element is electrically connected with said first connector socket for temporarily charging said electronic device when said electronic device is electrically connected with said first connector socket via said data transfer cable.

4. The multi-functional data storage and transmitting and connecting device, as recited in claim 1, wherein said first connector further has a protrusion and said second connector further has an engagement slot formed thereon, wherein said protrusion is arranged to detachably engage with said engagement slot when said data transfer cable is bent into a U-shaped cross section.

5. The multi-functional data storage and transmitting and connecting device, as recited in claim 1, wherein said coupling element further comprises a resilient actuator provided thereon in such a manner that said resilient actuator normally locks up said coupling element on said first and said second connector, but when said resilient actuator is actuated, said resilient actuator is arranged to release a holding force and allow said coupling element to detach from said first and said second connector.

6. The multi-functional data storage and transmitting and connecting device, as recited in claim 1, wherein said second connector is a USB connector or other digital connectors.

7. The multi-functional data storage and transmitting and connecting device, as recited in claim 1, wherein each of said first and said second connector is a USB connector or other digital connector.

* * * * *